United States Patent [19]

Hoene

[11] 4,037,136

[45] July 19, 1977

[54] CIRCUIT ARRANGEMENT FOR IGNITING AT LEAST ONE GAS DISCHARGE FLASH LAMP

[75] Inventor: Ernst-Ludwig Hoene, Singapore, Singapore

[73] Assignee: Heimann GmbH, Germany

[21] Appl. No.: 608,158

[22] Filed: Aug. 27, 1975

[30] Foreign Application Priority Data

Sept. 19, 1974 Germany ..... 2444893

[51] Int. Cl.[2] ..... H05B 37/00; H05B 37/00; H05B 41/14

[52] U.S. Cl. ..... 315/241 P; 315/200 A; 315/232; 315/234; 315/189

[58] Field of Search ..... 315/241 R, 241 P, 200 A, 315/202, 277, 228, 232, 324, 185 R, 189, 193, 178, 179, 180, 183

[56] References Cited

U.S. PATENT DOCUMENTS

| | | | |
|---|---|---|---|
| 3,080,503 | 3/1963 | Brooks | 315/232 |
| 3,444,432 | 5/1969 | Mahnken | 315/241 P |
| 3,543,125 | 10/1970 | Lawhead, Jr. | 315/241 R |
| 3,560,795 | 2/1971 | Pollack et al. | 315/241 R |
| 3,725,733 | 4/1973 | Mack et al. | 315/228 |
| 3,871,761 | 3/1975 | Mabrouk | 315/241 P |
| 3,912,968 | 10/1975 | Makamura | 315/241 R |
| 3,943,406 | 3/1976 | Vital et al. | 315/241 P |

*Primary Examiner*—Saxfield Chatmon, Jr.
*Attorney, Agent, or Firm*—Hill, Gross, Simpson, Van Santen, Steadman, Chiara & Simpson

[57] ABSTRACT

A circuit arrangement for igniting flash tubes, without using an ignition electrode, and having two main electrodes which are supplied with an ignition pulse parallel to a flash capacitor and an electronic switch, employs an electronic switch which also constitutes a gas discharge path. In particular the electronic switch may be realized as a flash tube.

2 Claims, 5 Drawing Figures

CIRCUIT ARRANGEMENT FOR IGNITING AT LEAST ONE GAS DISCHARGE FLASH LAMP

BACKGROUND OF THE INVENTION

1. Field of the Invention

This invention relates to a circuit arrangement for igniting at least one gas discharge flash tube which has two main electrodes connected to a voltage generator that supplies an ignition voltage pulse and parallel to a chargeable flash capacitor and an electronic switch.

2. Description of the Prior Art

Gas discharge flash lamps (flash tubes) serve for producing short intensive light flashes. Heretofore, the electrical energy stored in a capacitor (a flash capacitor) is converted into light through the ignition of a gas discharge in a high current arc operation. The ignition is effected by way of a high voltage pulse with which the discharge path is charged, in particular usually by way of an ignition electrode which is provided on the exterior of the flash tube, and usually in the form of a conductor in addition to the main electrodes. Since, however, an ignition electrode requires a technical expense and safety problems, i.e. the danger of touching by an operator, it has been considered that to an increasing extent to directly apply a high voltage pulse for causing an ignition of the gas discharge directly to the two main electrodes of the flash tube.

In order to ignite gas discharge flash lamps without utilizing an ignition electrode, the flash tube, the flash capacitor and the ignition voltage pulse generator may be quickly switched one behind the other. Then, the discharge current which produces the flash of light will flow by way of the ignition voltage pulse generator. Generally, the ignition voltage pulse generator is a transformer which has a secondary winding connected in the discharge circuit, which winding must not only stand the stress of the discharge current but also, due to its inductivity, must change the discharge operation in an undesired manner.

The aforementioned difficulties can be avoided when the secondary winding of the ignition transformer is connected in parallel to the flash tube. Such a circuit can be seen by reference to the German Offlegungschrift 1,638,977, for example. In that reference, a short circuiting of the ignition voltage pulse by way of the flash capacitor is prevented with the help of one or more diodes connected in the discharge circuit. Even if such a circuit has the advantage that the duration of the discharge process, thus the flash duration, is essentially only determined by the internal resistance of the flash tube and the capacitance of the flash capacitor, there still remains the drawback that only one-half wave of the ignition voltage pulse can become effective at the flash tube. Furthermore, the demands on the electronic properties of the diodes which are connected in the discharge circuit in series with the flash capacitor, are very high, since these diodes must be designed for high voltages in the blocked direction and high currents in the pass direction.

SUMMARY OF THE INVENTION

The primary object of the invention, therefore, resides in the provision of a circuit for igniting ignition electrode-free flash tubes without the aforementioned drawbacks.

In order to achieve the aforementioned objective, a circuit arrangement of the initially mentioned kind is generally provided, whereby in accordance with the invention, the electronic switch is also a gas discharge path.

An essential advantage of the invention is provided in that, although a flash tube is only ignited via its main electrodes, the flash capacitor and a gas discharge path exclusively form the discharge circuit. The additional gas discharge path will take on the function of the separation of the ignition voltage pulse generator from the flash capacitor. Therefore, the insertion of high value diodes blocking only in one direction will not be necessary any longer in the discharge circuit.

A circuit constructed in accordance with the invention is particularly advantageous when several flash tubes are to be operated in series. In such a case, the gas discharge path itself only needs to comprise a flash tube. However, a gas discharge container of a desired shape of gas filling, comprising two main electrodes and an ignition electrode, may be provided as a gas discharge path, as long as the high voltage at the ignition electrode does not present a danger, for example within a network device realized with the help of the invention.

The invention is particularly and preferably suited for lighting at least two flash tubes which comprise only main electrodes, independently of whether a further gas discharge path is provided with or without an ignition electrode. In such a construction, the flash tubes are connected in series and the directly interconnected main electrodes of adjacent flash tubes are respectively connected to the output of a voltage generator which supplies an ignition voltage pulse. If the voltage generator is an ignition transformer, as is well known in the prior art, then the connection of a main electrode of each flash tube, which electrode is not directly connected to the flash capacitor, with the secondary winding of the ignition transformer, is blocked off by way of capacitors or rectifiers in order to avoid a discharge current by way of the secondary winding of the ignition transformer.

BRIEF DESCRIPTION OF THE DRAWINGS

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
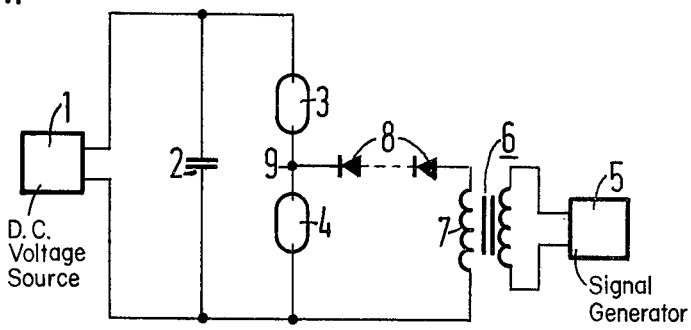
FIG. 1 is a schematic circuit diagram of a circuit arrangement constructed in accordance with the invention for igniting two series connected gas discharge containers.

Referring to FIG. 1, a direct voltage source 1 is provided for charging a flash capacitor 2 to a certain predetermined voltage. Two gas discharge containers 3 and 4 are connected in series with each other, by way of their main electrodes, and the series conbination is connected in parallel across the flash capacitor 2 and the voltage source 1. A signal generator 5 produces a high voltage pulse, as is well known in the art, with the help of an ignition transformer 6, whereby a pulse is produced in a secondary winding of the transformer 6 and is applied to respective main electrodes of the discharge containers 3 and 4 by way of a plurality of diodes 8. At least the gas discharge container 4 is a flash tube. This high voltage pulse cannot be short circuited via the flash capacitor 2 since the junction point 9 of the two discharge containers is separated from the flash capacitor 2 by way of the gas discharge containers 3 and 4, but the high voltage pulse will ignite the gas discharge containers 3 and 4 which thereupon discharge the capacitor 2. The diodes 8 serve for protecting the secondary winding 7 of the ignition transformer 6 from the voltage occurring at the point 9 during the discharge process. A capacitor 15, as can be seen in FIGS. 2 and 3, may take on this same function as will be apparent from the discussion below.

Figure 2:
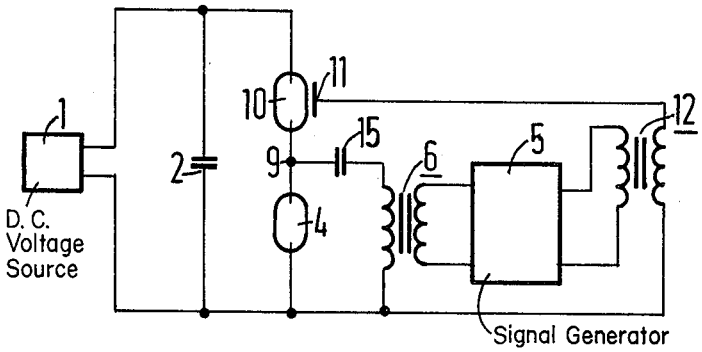
FIG. 2 is a schematic diagram of a circuit arrangement constructed in accordance with the invention in which one of the gas discharge containers comprises an ignition electrode.

FIG. 2 illustrates a circuit diagram which is equivalent to that of FIG. 1 to a great extent, but which has a difference in that a gas discharge container 10 is provided in place of the gas discharge container 3. The gas discharge container 10 comprises an ignition electrode 11 in addition to the two main electrodes. Furthermore, the gas discharge container 10 is designed in such a manner that the high voltage pulse produced by the ignition transformer 6 is not sufficient for igniting the discharge container 10. For this purpose, an ignition pulse is produced by an additional ignition transformer 12 and is supplied to the ignition electrode 10. As soon as the discharge container 10 has been ignited in this manner, the resistance at the outer discharge path decreases and permits the discharge of the capacitor 2 via the discharge container 10, and furthermore via the discharge container 4 which, as mentioned above, is a flash tube. This process may serve for operating a flash tube without ignition electrode at an exposed position, while the discharge container 10 may be placed at an uncritical location within a network where the high voltage occurring at the ignition electrode 11 does not present a problem.

Figure 3:
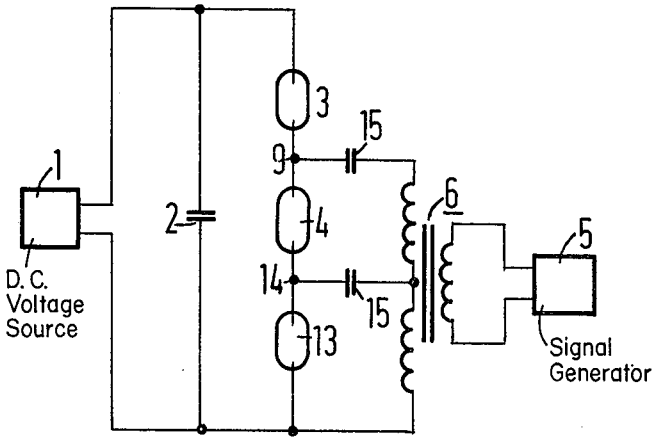
FIG. 3 is a schematic circuit diagram of a circuit arrangement constructed in accordance with the invention for igniting three series connected gas discharge containers.

In the exemplary embodiment illustrated in FIG. 3, three gas discharge containers 3, 4 and 13 are illustrated as being connected in series. The circuit also includes a flash capacitor 2 which can be charged by a direct voltage source 1, the series connection of the gas discharge containers 3, 4 and 13 being connected in parallel with the capacitor 2 and the source 1. An ignition transformer 6 comprises a pair of secondary windings which are designed in such a manner that a high voltage pulse which suffices for igniting the discharge containers 3 and 4 does not only appear at the point 9, but also a high voltage impulse for igniting the discharge container 13 will appear at the point 14. After ignition has taken place, the flash capacitor 2 discharges by way of the discharge containers 3, 4 and 13 and the capacitors 15 respectively block off the two secondary windings of the ignition transformer 6 before a voltage charging process.

Figure 4:
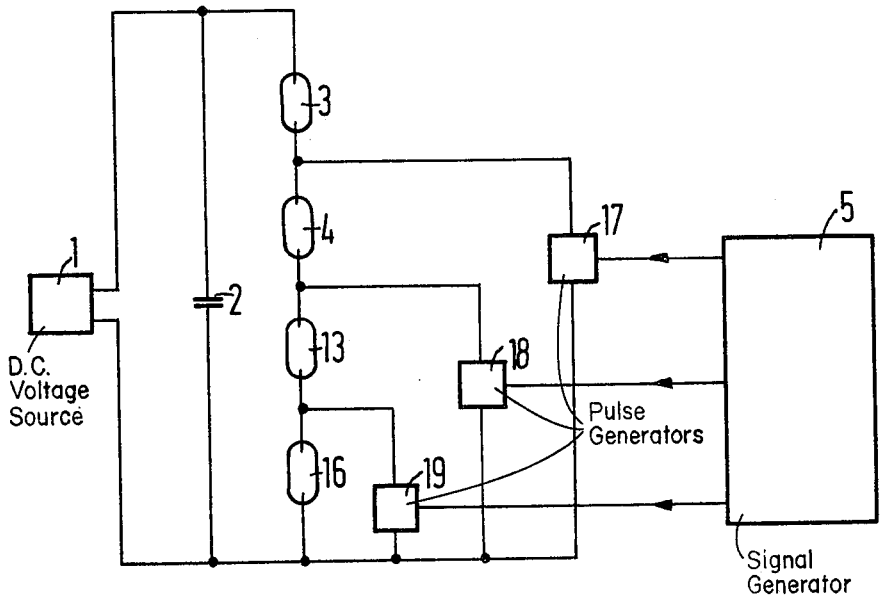
FIG. 4 is a schematic circuit diagram which illustrates the principle of the invention for igniting a large number of gas discharge containers in which a plurality of high voltage pulse generators are connected in parallel to respective flash tubes.
Figure 5:
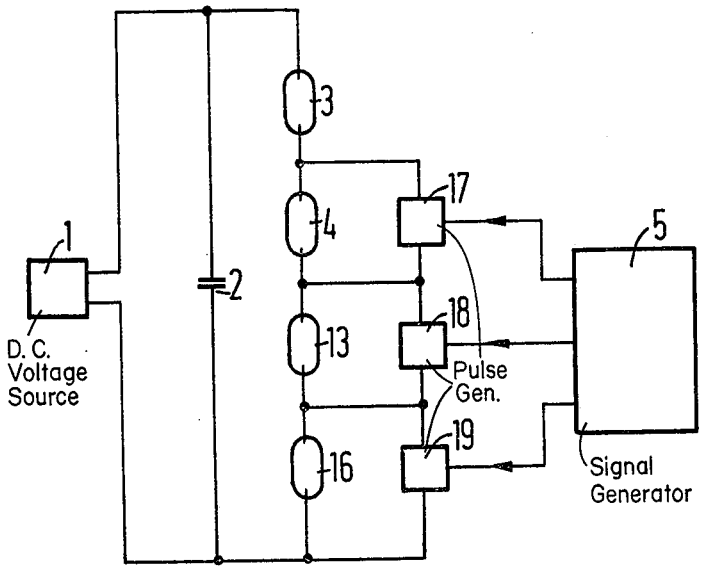
FIG. 5 is a schematic circuit diagram illustrating the principle of the invention for igniting a large number of gas discharge containers in which a plurality of high voltage pulse generators are connected in series with each other and in parallel with respective flash tubes.

The principle of the present invention can be expanded to a multitude of equal or different gas discharge containers connected in series across a flash capacitor. This principle is illustrated in FIGS. 4 and 5. As in the foregoing examples, a flash capacitor 2 is provided for charging by way of a direct voltage source 1. In addition to the gas discharge containers 3, 4 and 13, a further series connected gas discharge container 16 has been provided and represents an even larger number of gas discharge containers. A plurality of high voltage pulse generators 17–19, which are fed by a signal generator 5, have their outputs respectively connected with main electrodes of adjacent gas discharge containers which are not directly connected to the flash capacitor 2, either individually (FIG. 4) or in series with one another (FIG. 5). Due to the high voltage pulses supplied in this manner to the gas discharge containers 3, 4, 13 and 16, conductive plasm channels are produced in the individual gas discharge containers which are of such a low resistance that the voltage connected at the flash capacitor 2 suffices in order to supply sufficient energy for the further expansion of the plasm channels until the resistance of the entire discharge path through the individual containers is small enough in order to discharge the flash capacitor 2. A short circuit of the ignition pulses cannot occur since, on the one hand, the time for forming the plasm channels and the increase of the conductivity of the individual gas discharge containers which are connected therewith is several hundred μsec and, on the other hand, the time start of the break-through of the individual gas discharge containers is in a sufficiently rapid succession in order to prevent interruption of the discharge.

The invention is not limited to the above illustrative exemplary embodiments. In particular, it is not necessary that the ignition voltage pulse come from an ignition transformer, but the same may also be produced with the help of electronic component elements, such as a piezoelectric crystal. Furthermore, it is not necessary that the gas discharge containers be equal among each other if the containers only fulfill the conditions required for igniting the entire discharge path. Furthermore, one or more of the gas discharge containers connected in accordance with FIGS. 4 and 5 may be replaced by discharge containers which comprise an ignition electrode as in FIG. 2.

Other changes and modifications of the invention may become apparent to those skilled in the art without departing from the spirit and scope of the invention. I therefore intend to include within the patent warranted hereon, all such changes and modifications as may reasonably and properly be included within the scope of my contribution to the art.

I claim:

1. A flash arrangement comprising:

at least one first gas discharge flash lamp;

a flash capacitor;

a voltage source connected to charge said flash capacitor;

an electronic switch comprising a second flash lamp connected in series with said first flash lamp;

the series combination connected across said flash capacitor, said second flash lamp including a gas discharge path, each of said flash lamps comprising only main electrodes, a main electrode of each flash lamp connected to a main electrode of the other flash lamp to define a junction; and an ignition pulse generator connected to the junction of the two interconnected main electrodes.

2. A circuit arrangement for igniting at least one gas discharge flash lamp which includes two main electrodes, comprising:

a flash capacitor;

a voltage source connected to charge said flash capacitor;

an electronic switch connected in series with said flash lamp, the series combination connected across said flash capacitor, said electronic switch comprising a flash lamp including a gas discharge path; and an ignition pulse generator connected in parallel with the first-mentioned flash lamp, each of said flash lamps comprising only main electrodes, and a main electrode of each flash lamp connected to a main electrode of the other flash lamp to define a junction, and wherein said ignition pulse generator is connected to the junction of the two interconnected main electrodes.

* * * * *